United States Patent [19]

Palau et al.

[11] 4,444,225

[45] Apr. 24, 1984

[54] ROTATING DOBBIES

[75] Inventors: Joseph Palau, Duingt; Jean-Paul Froment, Doussard, both of France

[73] Assignee: S.A. Des Etablissements Staubli, Fauerges, France

[21] Appl. No.: 407,512

[22] Filed: Aug. 12, 1982

[30] Foreign Application Priority Data

Oct. 29, 1981 [FR] France ..... 81 20502

[51] Int. Cl.[3] ..... D03C 1/00

[52] U.S. Cl. ..... 139/66 R; 139/76

[58] Field of Search ..... 139/66 R, 76, 74, 71, 139/68

[56] References Cited

U.S. PATENT DOCUMENTS 4,387,741 6/1983 Palau et al. ..... 139/66 R

FOREIGN PATENT DOCUMENTS 48292 3/1982 European Pat. Off. ..... 76/

2741199 2/1979 Fed. Rep. of Germany ..... 139/76

315727 10/1971 U.S.S.R. ..... 139/68

761627 9/1980 U.S.S.R. ..... 139/76

*Primary Examiner*—James Kee Chi

*Attorney, Agent, or Firm*—Dowell & Dowell

[57] ABSTRACT

The present invention relates to improvements in rotating dobbies. The control of the coupling pawl for connection to the driving shaft is effected by one of two right-angled pivoting levers actuated in the same zone by push elements of the reading device of the dobby. When a lever engages in a notch in a plate fixed to the eccentric, the nose of the engaged one of the pivoting levers pushes a catch on the pawl which pivots the pawl causing the withdrawal of its finger to release connection with drive from the shaft.

4 Claims, 4 Drawing Figures

A
15
14
13
14
11a
12
11
3b
3a
11b
8b
8
9
8a
10
12
13
11
11b
7
7a
7a
2
1
4a
3
4
5
6
R
H

ROTATING DOBBIES

The present invention relates to dobbies of the rotating type for forming the shed on weaving looms.

It is known that, in rotating dobbies, the lifting and lowering movement of the heddle frames is ensured by oscillating elements constituted either by rod-lever assemblies or by roller-bearing levers, said oscillating elements being controlled by actuating elements (in the form of eccentrics in the first case, cams in the second) mounted on the main shaft of the system. This shaft is driven by an intermittent movement of rotation and, at every stop, i.e. every half revolution of said shaft, the reading device must, at each of the needles of the dobby (i.e. of the actuating assembly associated with each heddle frame),and as a function of the pattern or weave to be obtained on the fabric being woven, connect the actuating element either with said shaft to control the oscillating element, or with the latter to effect angular immobilisation thereof.

This selective connection is generally obtained with the aid of a mobile coupling member in the form of a key or pawl, subjected to the action of two articulated levers disposed on either side of the shaft in order to actuate said mobile member to the two positions of stop thereof. These two levers are generally coupled to a single connecting rod adapted to move axially in one direction and in the other as a function of the control received from the reading device of the dobby, elastic return means ensuring return of the mobile member, the levers and the connecting rod to a rest position.

It will be readily understood that such a control mechanism operates under poor conditions due in particular to its asymmetric character. When the connecting rod in question moves, the two levers are simultaneously actuated whilst only one of them has a role to perform. If, for one lever, actuation is effected in one direction by the reading device and in the opposite direction by a spring, for the other lever, the mode of actuation is necessarily reversed. It is therefore not possible to use springs of perfectly optimised force, since their actions do not have the same purpose.

Furthermore, it will be noted that the force of the elastic return means is limited, which is detrimental to the precision of the control obtained. It should be considered that the necessity of providing a safety mechanism intended to guard against the possibility of the mobile coupling member being actuated and displaced incompletely, further complicates the construction of the whole of the control mechanism whose operation in any case remains unreliable.

It is an object of the present invention to remedy these drawbacks, by arranging the pivoting control levers so that they exert a perfectly symmetrical action both on the mobile coupling pawl member with a view to displacement thereof for connecting the shaft and the heddle element, and on the latter with a view to angular immobilisation thereof.

To this end, there are associated with these control levers, actuated individually by the reading device at one of their ends, elastic means which tend to retract their noses at diametrically opposite ends radially away from the shaft. Each nose is adapted to cooperate with a notch made in the periphery of a plate laterally fixed to the actuating element with a view to ensuring angular immboilisation of the latter and of the corresponding heddle actuating connecting rod element.

It will be understood that, if care is taken to mount the coupling pawl member on the above-mentioned plate so that it is actuated by the nose of one or the other of the two levers, and to associate with said pawl member elastic return means which tend to engage its free end or finger in one or the other of two notches made in the shaft or in a drive disc fixed thereto, a controlled coupling system of simple, robust and reliable construction is produced. It will be noted in particular that the terminal nose of each lever and the notch of the lateral plate of the actuating element may be given a conical or flared section which ensures on the one hand perfectly precise centering of this plate and on the other hand a tendency to eject the nose without damage, this latter effect being a safety measure in the case of incomplete engagement of the mobile coupling member.

Further, the perfectly precise positioning of this member, combined with its elastic return into a position of coupling make it possible to shape its free end with a finger and to shape each of the notches provided in the shaft or in the drive disc, to provide cooperating cross-sections section adapted to avoid any component of ejection. Consequently, contrary to the conventional systems, there is no need to provide any particular means for locking the mobile member in coupling position.

The invention will be more readily understood on reading the following description with reference to the accompanying drawings, in which.

Figure 1:
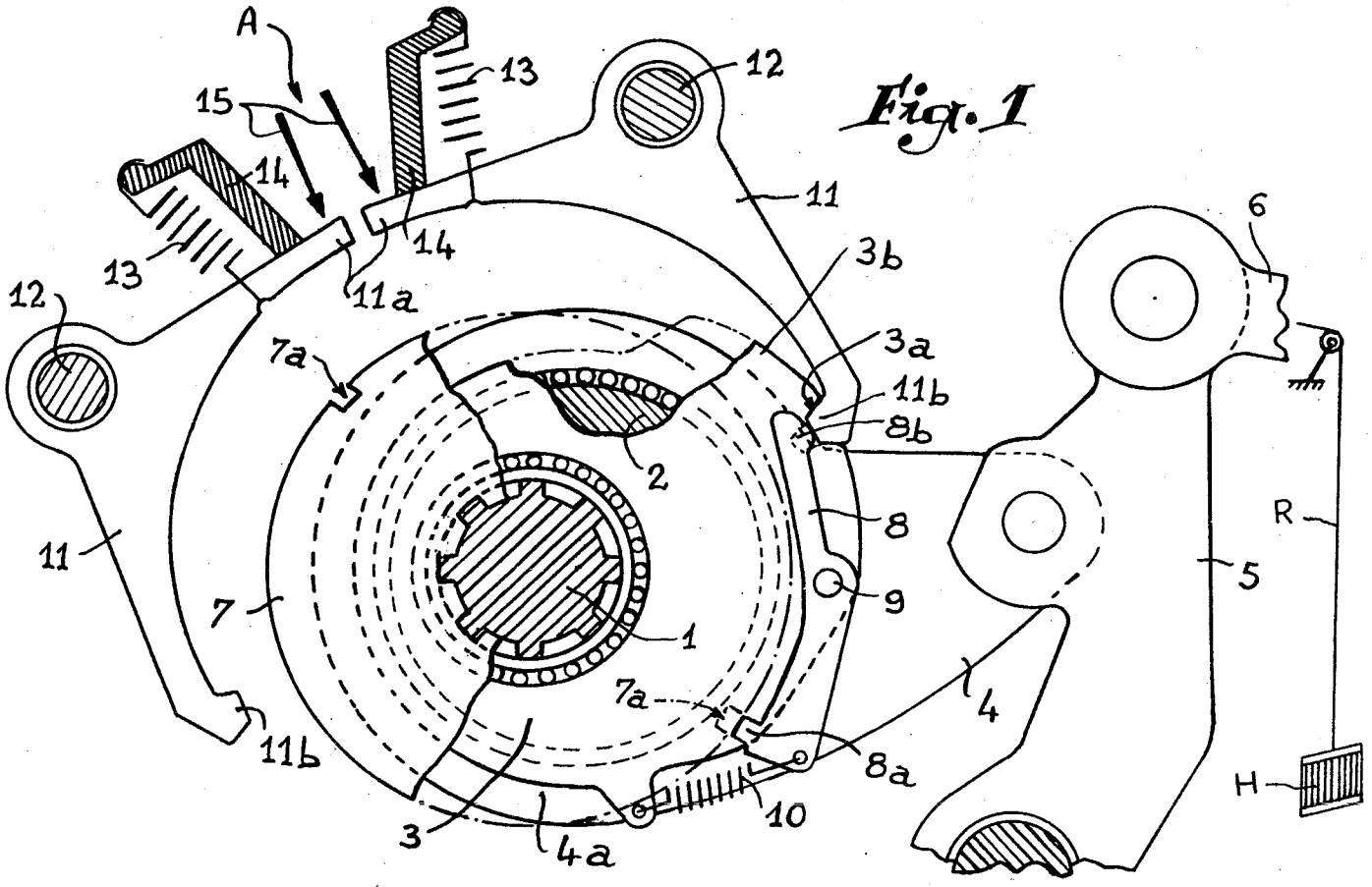
FIG. 1 is a schematic transverse section of a dobby according to the invention.
Figure 2:
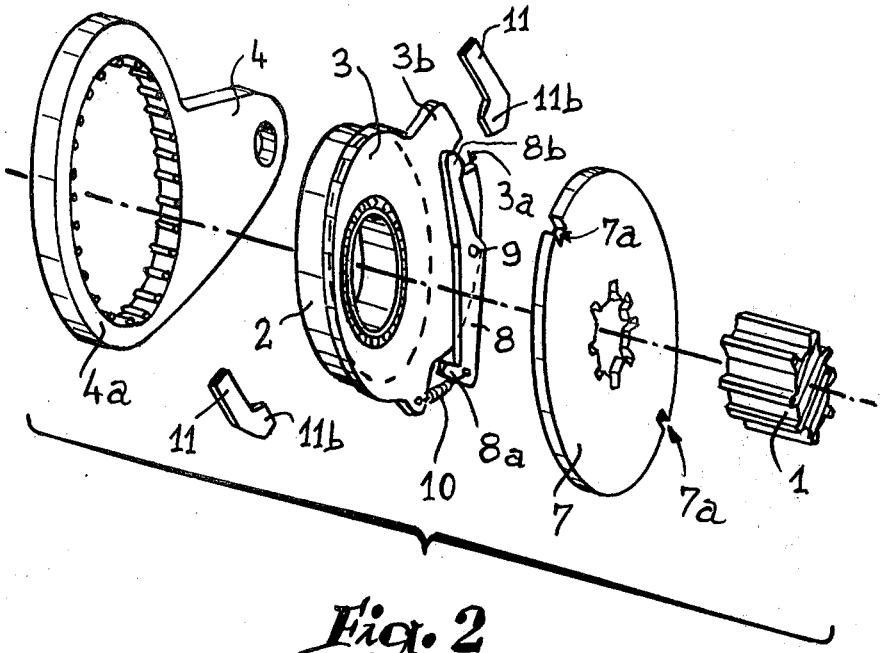
FIG. 2 is an exploded view in perspective showing, in dismantled state, the different elements for actuating one of the needles of the dobby according to FIG. 1.
Figure 3:
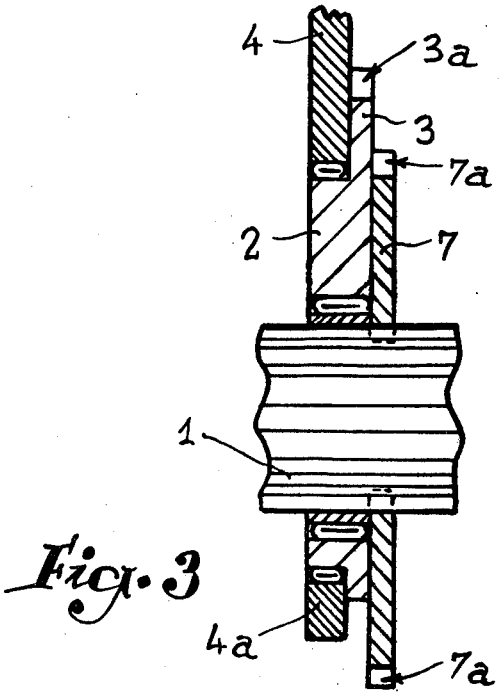
FIG. 3 is a partial axial section showing, to a larger scale, the elements of FIG. 2 once mounted in position.

Referring now to the drawings, the dobby in question comprises a main shaft driven by an intermittent movement of rotation with stop every 180°. At each of the needles of the dobby, this shaft 1 supports, with interposition of an intermediate bearing, an eccentric 2 laterally fixed to a plate 3; the cylindrical periphery of the eccentric 2 is engaged, still with interposition of an intermediate bearing, inside the open circular boss 4*a* of an actuating connecting rod 4. The free end of this connecting rod 4 is coupled, through a pivoting arm 5, to the conventional drawing lever 6 connected, for example by a cable R, to the corresponding heddle frame schematised by H.

With each of the eccentrics 2 is associated a drive disc 7 whose axial opening is provided to be crenelated so as to cooperate with the periphery, itself crenelated, of the shaft 1. The periphery of this disc 7 is provided with two radial notches 7*a* diametrically opposite each other. These notches 7*a* are adapted selectively to receive the terminal finger 8*a* of a pawl 8 articuated on a spindle 9 fixed to the lateral plate 3 of the eccentric 2. A spring 10 tends to urge the finger 8*a* of the pawl 8 continuously in the direction of the shaft 1.

To control this pawl 8, there are provided two levers 11 pivotally borne on fixed spindles 12 arranged in the casing of the dobby parallel to the main shaft 1 thereof. Each lever 11 has a right-angled section and is urged by a spring 13 so as to come into abutment against a corresponding fixed stop 14. These two stops 14 thus define on each lever 11 an actuating end 11*a* and it will be readily understood that the two ends, disposed in the same zone A, may be controlled by push elements (shown schematically in the form of arrows 15) of the reading device of the dobby.

Figure 4:
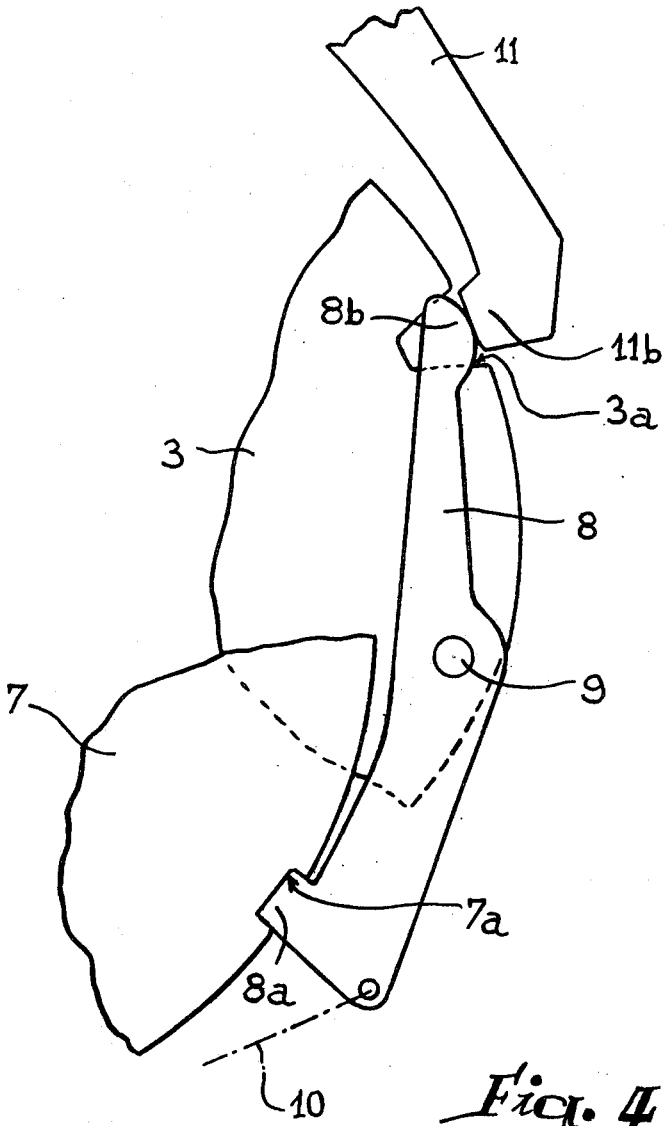
FIG. 4 shows to a larger scale part of FIG. 1 in another position of the pawl.

The end of each lever 11 opposite the end 11*a* is sectioned in the form of a nose 11*b*, the two noses 11*b* corresponding to each of the needles of the system being disposed on either side of the shaft 1 along the same diametrical axis. Each nose 11*b* is adapted to engage in a notch 3*a* made radially in a projecting lug 3*b* on the plate 3 and, referring to FIG. 4, it will be noted:

that each of the noses 11*b* and the notch 3*a* presents a flared section which ensures a very precise positioning of the plate 3 and of the pawl 8 borne thereby;

and that a catch 8*b* provided on this pawl 8 opposite its finger 8*a* is disposed opposite the notch 3*a*, so that the nose 11*b* which engages in said notch pushes the said catch and consequently controls pivoting of the pawl.

Operation of the above dobby follows from the foregoing explanations and is readily understood.

When the two push elements 15 of the reading device are in the retracted position illustrated in FIG. 1, the springs 13 maintain the two levers 11 in contact with the fixed stops 14, so that the noses 11*b* of these levers are disposed on the circular trajectory of the lug 3*b* of the plate 3. Under these conditions, when the eccentric 2 and its lateral plate 3 move angularly, one or the other of the two noses 11*b* will be raised by the front part of the lug 3*b* against the spring 13 of the corresponding lever 11, which spring effects automatic engagement of the nose 11*b* in question inside the notch 3*a*.

This engagement, which occurs concomitantly with one of the periodic stops of the shaft 1, effects subsequent angular immobilisation of the eccentric 2, so that the latter is retained in stop position when the shaft 1 is again rotated. At the same time, the said engagement has caused pivoting of the pawl 8 by the action of the nose 11*b* against the catch 8*b*. The finger 8*a* of the said pawl is thus extracted from the notch 7*a* in which it was engaged. The effect of this extraction is to uncouple the drive disc 7 from the eccentric 2.

If it is assumed that, upon the following stop of the shaft 1, the same lever 11 is actuated by its push element 15, the pivoting of this lever causes the withdrawal of the nose 11*b* from the notch 3*a* and the spring return of the pawl 8 to the position for which its finger 8*a* is engaged in the notch 7*a* thereopposite. The eccentric 2 is then coupled to the shaft 1 through the disc 7, the pawl 8 and the plate 3, so that it moves angularly with the shaft, provoking the displacement of the connecting rod 4 and movement of the drawing lever 6 which is coupled thereto.

It will be noted that the assembly associated with each of the needles of the dobby presents perfect symmetry due to the right-angled section of the levers 11 and the right angle formed by the pivots 12 with respect to the axis of the shaft 1. These two levers are controlled in a single zone A, which obviously simplifies the arrangement of the reading device. The action of the levers 11 is itself symmetrical since their angular displacement is effected either by the push elements 15 mentioned above, or by the springs 13 which may thus be calibrated precisely.

It will be observed on this point that these springs 13 may develop a considerable force which is applied to the pawl 8 at 8*a*. The pawl is thus controlled under excellent conditions both for engagement and for withdrawal. The conical or flared section of the noses 11*b* and of the notch 3*a* ensures, in addition to the precise positioning of the pawl, the function of safety obligatorily introduced in the coupling system, since, in the event of the finger 8*a* remaining partially engaged in the notch 7*a* whilst the plate 3 of the eccentric 2 is still retained by one of the noses 11*b*, due to a faulty control, there would be automatic ejection of said nose due to the obliqueness or conicity of the bearing surfaces in contact at notch 3*a* level.

It will further be noted that for the purpose of perfectly precise positioning of the pawl 8 and its finger 8*a*, the lateral faces of the latter and those of each of the notches 7*a* of the disc 7 may be oriented so as to avoid any component of ejection. This pawl therefore requires no locking for the finger 8*a* to remain engaged in one or the other of the two notches 7*a*, contrary to conventional arrangements.

It must be understood that the preceding description has been given only by way of example and that it in no way limits the domain of the invention, the replacement of the details of execution described by any other equivalents not departing from the scope thereof. In particular, it will be noted that, if implementation of the invention proves particularly advantageous in the case of rotating dobbies of the type described in detail hereinabove, alternatively the finger 8*a* of each pawl 8 may be arranged to engage in notches made, no longer in the periphery of a drive disc such as 7, but directly in the surface of the main shaft 1.

Furthermore, it will be readily appreciated that the invention is advantageously applicable to rotating dobbies in which the actuating elements are constituted by cams against the periphery of which are maintained in abutment follower rollers borne by traction levers coupled to the heddle frames. It goes without saying that the coupling members may, in known manner, take the form of keys radially movable in housings made laterally in the eccentrics or the cams so as to be able to be manoeuvred by the terminal noses 11*b* of the levers 11 when said noses engage in the notches 3*a*.

What is claimed is:

1. In a dobby of the rotating type having multiple control elements each including an actuating rod for each heddle frame of a weaving loom, the loom having a main shaft driven with intermittent rotational motion and having reading-device push elements located adjacent to the shaft, each control element comprising:

(a) an open circular boss on the heddle frame actuating rod and surrounding the shaft;

(b) an eccentric member rotatably supported on the shaft and having an outer surface eccentrically offset from its center of rotation on which the circular boss of the actuating rod is rotatably supported;

(c) a plate member fixed to the eccentric member for rotation therewith, the plate member having an outer periphery with a notch therein;

(d) a pawl pivotally supported by the plate member adjacent thereto, the pawl having a first end having a finger thereon extending toward the shaft and having a second end underlying said notch in the plate member;

(e) drive means on the shaft and disposed to underlie the pawl and including two diametrically opposed notches shaped to receive said finger;

(f) a spring urging the pawl to pivot in a direction to insert its finger into a drive means notch; and (g) two levers supported on fixed pivots, the levers respectively having ends carrying diametrically opposed noses extending toward the shaft and located opposite the outer surface of the plate member, and the levers having spring means urging the levers to pivot in directions to move their outer ends toward engagement of a nose in the notch in the surface of the plate member and to thereby displace the second end of the pawl to disengage its finger from a notch in the drive means, and the levers respectively having control ends disposed to be engaged by the reading-device push elements to pivot the levers to move their noses away from engagement in the notch in the surface of the plate member.

2. A dobby as claimed in claim 1, wherein the two notches in the drive means and the finger have substantially radially disposed mutually-engaging surfaces, whereby the finger tends to remain engaged in one of the notches without necessity of being locked therein.

3. A dobby as claimed in claim 1, wherein the two levers each have lever portions which extend at right angles from their pivots and which support their respective outer ends and control ends, the levers being symetrically disposed about the shaft with their control ends extending toward eachother into a zone containing said push elements.

4. A dobby as claimed in claim 1, wherein the notch in the plate member and the noses at the outer ends of the levers are flared radially outwardly from the shaft with mating cross-sections, whereby to ensure precise positioning of the eccentric member when a nose engages the notch in the plate member.

* * * * *